US007469680B2

(12) United States Patent
Merchant et al.

(10) Patent No.: US 7,469,680 B2
(45) Date of Patent: Dec. 30, 2008

(54) FLUID SYSTEM HAVING QUILL-MOUNTED MANIFOLD

(75) Inventors: Jack A. Merchant, Peoria, IL (US); Paul F. Olsen, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 385 days.

(21) Appl. No.: 11/239,220

(22) Filed: Sep. 30, 2005

(65) Prior Publication Data

US 2007/0074704 A1 Apr. 5, 2007

(51) Int. Cl.
*F02M 55/02* (2006.01)

(52) U.S. Cl. ..... 123/456; 123/468; 123/469

(58) Field of Classification Search ..... 123/456, 123/468–470

See application file for complete search history.

(56) References Cited

U.S. PATENT DOCUMENTS 4,334,512 A * 6/1982 Biernath ..... 123/469
5,713,323 A * 2/1998 Walsh et al. ..... 123/184.42
5,775,302 A 7/1998 Guido et al.
6,073,612 A * 6/2000 Ohkubo et al. ..... 123/456
6,374,805 B1 4/2002 Seymour, II et al.
6,374,806 B1 4/2002 Keeley et al.
6,467,457 B1 10/2002 Lei et al.
6,497,219 B2 12/2002 Natsume
6,619,264 B2 9/2003 Bolsover et al.
6,772,736 B2 8/2004 Liskow
6,871,637 B2 3/2005 Tsuchiya et al.
6,892,704 B2 5/2005 Tsuchiya et al.
7,040,294 B2 * 5/2006 Yagisawa et al. ..... 123/468
7,159,569 B2 * 1/2007 Keegan et al. ..... 123/456
2002/0112697 A1 * 8/2002 Knoedl et al. ..... 123/456
2003/0183200 A1 * 10/2003 Bugos ..... 123/470
2005/0166899 A1 8/2005 Shamine et al.

FOREIGN PATENT DOCUMENTS

EP 1 046 810 A2 10/2000
EP 1 150 002 A1 10/2001
FR 2 450 357 9/1980
JP 10-299610 11/1998

OTHER PUBLICATIONS

PCT International Search Report; PCT/US2006/032465; Filing Date: Aug. 18, 2006; Applicant: Caterpillar Inc., Mailed Dec. 15, 2006.

* cited by examiner

*Primary Examiner*—Thomas N Moulis
(74) *Attorney, Agent, or Firm*—Finnegan, Henderson, Farabow, Garrett & Dunner

(57) ABSTRACT

A fluid system for an engine is disclosed. The fluid system has a manifold with a plurality ports, and a retention device configured to constrain the manifold relative to the engine in only a single translational direction. The fluid system also has a plurality of tubes configured to communicate fluid from the ports with the engine and to constrain the manifold in the remaining translational directions.

23 Claims, 2 Drawing Sheets

FLUID SYSTEM HAVING QUILL-MOUNTED MANIFOLD

TECHNICAL FIELD

The present disclosure is directed to a fluid system and, more particularly, to a fluid system having a quill-mounted manifold.

BACKGROUND

Fuel systems typically employ multiple fuel injectors to inject high pressure fuel into combustion chambers of an engine. This high pressure fuel is supplied to the fuel injectors via a common manifold secured to the engine and individual supply lines connected between the common manifold and the injectors. During manufacture and assembly of the manifold, supply lines, injectors, and engine, it is possible for misalignment to occur between the various mounting devices (e.g., holes, protrusions, studs, ports, seats, etc.). In fact, this misalignment can be significant enough that excessive stresses are experienced by the supply lines and the common manifold during the assembly process and operation of the engine, or that assembly may not even be possible. If left unchecked, the excessive stresses could possibly result in rupture of or leakage from the supply lines or common manifold.

One way of reducing the stress induced in the supply lines and improving the likelihood of proper assembly and fluid sealing is described in U.S. Pat. No. 6,928,984 (the '984 patent) issued to Shamnine et al. on Aug. 16, 2005. The '984 patent describes a high pressure fuel system having a common fuel rail bolted to an engine block, and an elbow bolted between each cylinder head and the common fuel rail. The elbow includes a spherical sealing surface that engages a conical seating surface of the common fuel rail to provide fluid retention between the rail and elbow. In this manner, during slight misalignment between the engine block and the cylinder head, the spherical sealing surface may pivot within the conical seating surface and remain in sealing contact without inducing significant stresses in the rail or elbow.

Although the high pressure fluid system of the '984 patent may provide fluid retention between the common rail and cylinder head while minimizing the stress induced to the elbow or common rail during misaligned assembly, it may be complex, costly, and not applicable in all situations. Specifically, the high pressure fluid system of the '984 patent requires many different components to connect the elbow to the common fuel rail. The large number of components increases the assembly time, the associated assembly cost, and the initial system hardware cost. In addition, although the high pressure fluid system of the '984 patent may accommodate slight misalignments, greater misalignments within the system may still induce undesired levels of stress.

The fluid system of the present disclosure solves one or more of the problems set forth above.

SUMMARY OF THE INVENTION

A fluid system for an engine includes a manifold having a plurality ports and a retention device configured to constrain the manifold relative to the engine in only a single translational direction. The fluid system also has a plurality of tubes configured to communicate fluid from the ports with the engine and to constrain the manifold in the remaining translational directions.

In another aspect, the present disclosure is directed to a method of assembling a manifold to an engine. The method includes engaging a retention device with the manifold to constrain the manifold relative to the engine in only a single translational direction. The method also includes engaging the manifold with a plurality of tubes extending from the engine to communicate fluid from the manifold with the engine and to constrain the manifold relative to the engine in the remaining translational directions.

DETAILED DESCRIPTION

Figure 1:
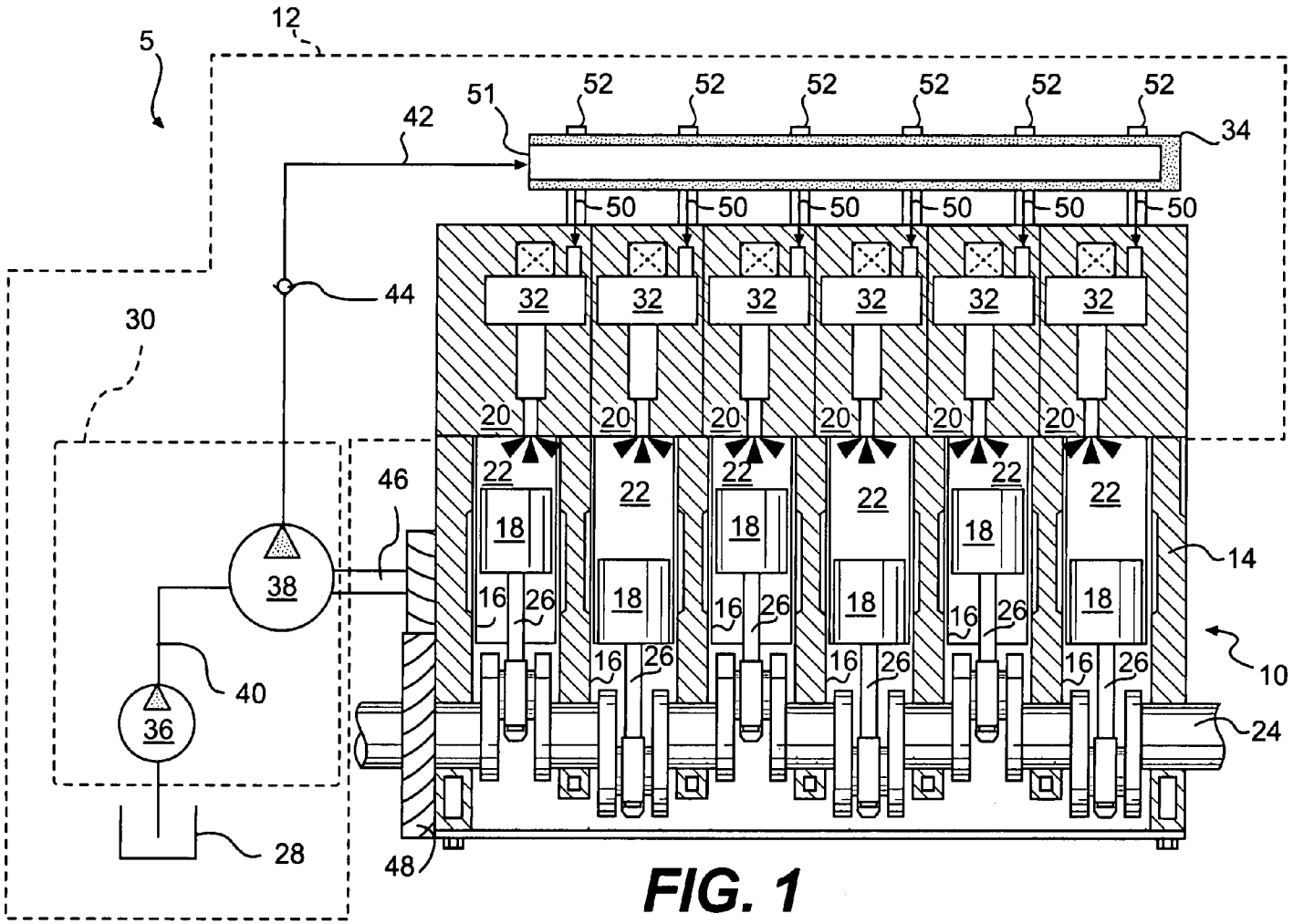
FIG. 1 is a schematic and diagrammatic illustration of an exemplary disclosed power system.

FIG. 1 illustrates a power system 5 having an engine 10 connected to an exemplary embodiment of a fuel system 12. Power system 5 may generate a power output as part of a work machine that performs some type of operation associated with an industry such as mining, construction, farming, transportation, power generation, or any other industry known in the art. For example, power system 5 may embody the primary mover for a mobile machine such as an excavator, a dump truck, a backhoe, a bus, a marine vessel, or any other mobile machine known in the art. Alternatively, power system 5 may embody the primary power source in a stationary machine such as a generator set, a pump, or any other stationary machine known in the art.

Engine 10 may be, for example, a diesel engine, a gasoline engine, a gaseous fuel-powered engine, a heavy fuel engine, or any other type of engine apparent to one skilled in the art. Engine 10 may include an engine block 14 that defines a plurality of cylinders 16, a piston 18 slidably disposed within each cylinder 16, and a cylinder head 20 associated with each cylinder 16. Cylinder 16, piston 18, and cylinder head 20 may form a combustion chamber 22. In the illustrated embodiment, engine 10 includes six combustion chambers 22. However, it is contemplated that engine 10 may include a greater or lesser number of combustion chambers 22 and that combustion chambers 22 may be disposed in an "in-line" configuration, a "V" configuration, or any other suitable configuration.

As also shown in FIG. 1, engine 10 may include a crankshaft 24 that is rotatably disposed within engine block 14. A connecting rod 26 may connect each piston 18 to crankshaft 24 so that a sliding motion of piston 18 within each respective cylinder 16 results in a rotation of crankshaft 24. Similarly, a rotation of crankshaft 24 may result in a sliding motion of piston 18.

Fuel system 12 may include components that cooperate to deliver injections of pressurized fuel into each combustion chamber 22 of engine 10. Specifically, fuel system 12 may include a tank 28 configured to hold a supply of fuel, and a fuel pumping arrangement 30 configured to pressurize the fuel and direct the pressurized fuel to a plurality of fuel injectors 32 by way of a common manifold 34.

Tank 28 may constitute a reservoir configured to hold a supply of fluid. In the disclosed embodiment, the fluid may include an engine fuel. However, it should be noted that tank 28 could readily be associated with a system of power source 5 other than fuel system 12 and configured to hold, for example, a hydraulic oil, an engine lubrication oil, a transmission lubrication oil, or any other fluid known in the art.

Fuel pumping arrangement 30 may include one or more pumping devices that function to increase the pressure of the fuel and direct one or more pressurized streams of fuel to common manifold 34. In one example, fuel pumping arrangement 30 includes a low pressure source 36 and a high pressure source 38 disposed in series and fluidly connected by way of a fuel line 40. Low pressure source 36 may embody a transfer pump configured to provide low pressure feed to high pressure source 38. High pressure source 38 may be configured to receive the low pressure feed and to increase the pressure of the fuel to the range of about 40-190 MPa. High pressure source 38 may be connected to common manifold 34 by way of a fuel line 42. A check valve 44 may be disposed within fuel line 42 to provide for one-directional flow of fuel from fuel pumping arrangement 30 to common manifold 34.

One or both of low and high pressure sources 36, 38 may be operably connected to engine 10 and driven by crankshaft 24. Low and/or high pressure sources 36, 38 may be connected with crankshaft 24 in any manner readily apparent to one skilled in the art where a rotation of crankshaft 24 will result in a corresponding rotation of a pump drive shaft. For example, a pump driveshaft 46 of high pressure source 38 is shown in FIG. 1 as being connected to crankshaft 24 through a gear train 48. It is contemplated, however, that one or both of low and high pressure sources 36, 38 may alternatively be driven electrically, hydraulically, pneumatically, or in any other appropriate manner.

Fuel injectors 32 may be disposed within cylinder heads 20 and connected to common manifold 34 by way of a plurality of fuel tubes 50. Each fuel injector 32 may be operable to inject an amount of pressurized fuel into an associated combustion chamber 22 at predetermined timings, fuel pressures, and fuel flow rates. Fuel injectors 32 may be hydraulically, mechanically, electrically, or pneumatically operated.

The timing of fuel injection into combustion chamber 22 may be synchronized with the motion of piston 18. For example, fuel may be injected as piston 18 nears a top-dead-center position in a compression stroke to allow for compression-ignited-combustion of the injected fuel. Alternatively, fuel may be injected as piston 18 begins the compression stroke heading towards a top-dead-center position for homogenous charge compression ignition operation. Fuel may also be injected as piston 18 is moving from a top-dead-center position towards a bottom-dead-center position during an expansion stroke for a late post injection to create a reducing atmosphere for aftertreatment regeneration.

Common manifold 34 may be configured to distribute fluid to each of fuel injectors 32 and may include an inlet 51 in communication with fuel line 42. It is contemplated that multiple common manifolds 34 may be included within power system 5, each common manifold 34 distributing fluid to fuel injectors 32 associated with separate banks of combustion chambers 22.

Figure 2:
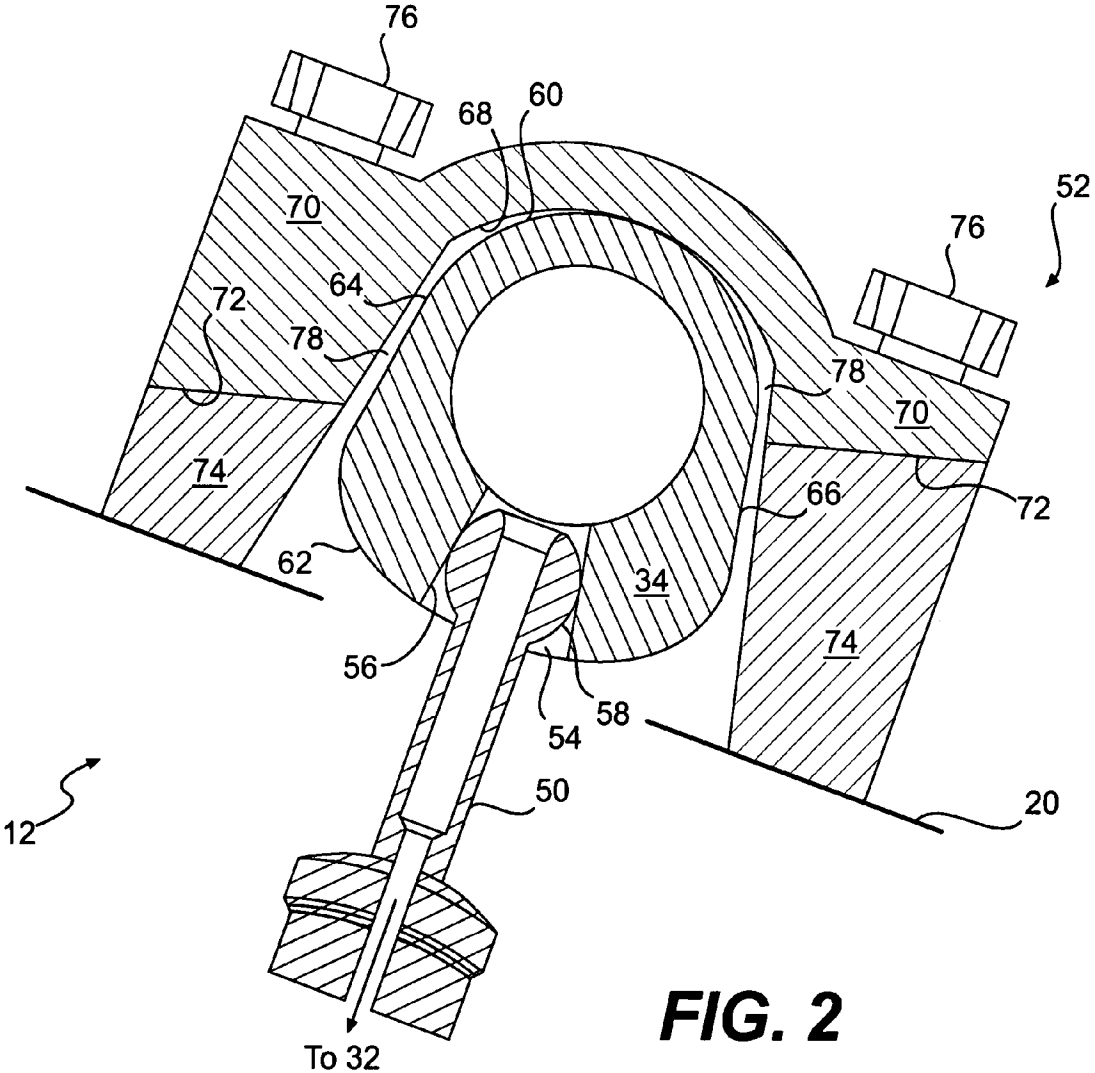
FIG. 2 is a cross-sectional illustration of an exemplary disclosed fuel system for the power system of FIG. 1.

FIG. 2 illustrates an exemplary arrangement for sealing the connection between fuel tubes 50 and common manifold 34. In particular, common manifold 34 may include a plurality of ports 54 configured to receive fuel tubes 50. Each of ports 54 may include a female conical seating surface 56, while each of fuel tubes 50 may embody quill tubes having a male spherical sealing surfaces 58. For the purposes of this disclosure, a quill tube may be considered a tube having a male spherical sealing surface with an outer diameter greater than an outer diameter of the proximal tube portion. The reduction in diameter may provide added flexibility in the tube. During assembly, as the male spherical sealing surfaces 58 of fuel tubes 50 engage the shallow angled female conical seating surfaces 56 of ports 54, one or both of the surfaces may deform and/or deflect slightly and a sealing interface may be created therebetween that is maintained even during relative rotational or translational movement between fuel tubes 50 and common manifold 34. Fuel tubes 50 may connect to fuel injectors 32 in a conventional manner. It is contemplated that common manifold 34 may alternatively include the male spherical sealing surfaces and fuel tubes 50 the female conical seating surfaces, if desired.

Ports 54 may be located at a position within common manifold 34 that provides the greatest material strength. In particular, as illustrated in the manifold cross-section of FIG. 2, common manifold 34 may be asymmetric, having a first outer arcuate surface 60, a second outer arcuate surface 62, and two flat outer surfaces 64, 66 connecting first and second outer arcuate surfaces 60, 62. The arc length of second outer arcuate surface 62 may be greater than the arc length of first outer arcuate surface 60 such that a maximum amount of material surrounds port 54, thereby imparting increased strength to female conical seating surface 56.

The sealing interface between fuel tubes 50 and common manifold 34 may be maintained as common manifold 34 is urged toward fuel tubes 50 (e.g., female conical seating surface 56 is engaged with male spherical sealing surface 58) by a plurality of retention devices 52. Specifically, one retention device 52 may be associated with each port 54 and configured to engage engine 10. In one example, retention device 52 may embody a clamp having a recessed portion 68 configured to receive common manifold 34, and a fastening portion 70 located to either side of recessed portion 68. Fastening portions 70 may each include a mounting face 72 configured to mate against an engine mount 74, and a through hole (not shown) for accommodating a fastener 76. Fasteners 76 may engage threads (not shown) within engine mounts 74 such that, upon tightening of fasteners 76, recessed portion 68 may urge common manifold 34 toward fuel tubes 50 in an axial direction of fuel tubes 50. It is contemplated that engine mounts 74 may be integral with cylinder heads 20, engine block 14, or any other suitable components of engine 10. It is also contemplated that engine mounts 74 may be omitted, if desired, and retention devices 52 configured to directly engage cylinder heads 20 or engine block 14.

Retention devices 52 may constrain common manifold 34 in only a single translational direction. Specifically, after assembly of retention device 52 to engine 10, a space 78 may exist between the flat outer surfaces 64, 66 of common manifold 34 and retention devices 52. Because only recessed portion 68 of retention devices 52 may contact common manifold 34, and recessed portion 68 only contacts common manifold 34 on first outer arcuate surface 60, retention devices 52 may serve to prevent common manifold 34 from moving away from fuel tubes 50 in only the axial direction of fuel tubes 50.

Fuel tubes 50 may constrain common manifold 34 in the remaining translational directions. In particular, once female conical seating surface 56 is engaged with male spherical sealing surface 58, common manifold 34 may be prevented from further movement toward fuel tubes 50 in the axial direction, from translational movement in either axial direction of common manifold 34, and from translational movement in a direction orthogonal to the axial directions of fuel tubes 50 and common manifold 34. In addition, because multiple fuel tubes 50 may engage multiple ports 54 along the axial direction of common manifold 34, rotational movement in any direction may also be prevented after assembly.

INDUSTRIAL APPLICABILITY

The fluid system of the present disclosure has wide applications in a variety of engine types including, for example, diesel engines, gasoline engines, gaseous fuel-powered engines, and heavy fuel engines. The disclosed fluid system may be implemented into any engine that utilizes a common manifold for distributing pressurized fluid such as oil or fuel, where misalignment between mounting devices and fluid retention may be important. Assembly of fuel system 12 will now be described.

During assembly, fuel tubes 50 may be connected to fuel injectors 32 and to common manifold 34 for the communication of high pressure fuel. In particular, one end of fuel tubes 50 may be connected to fuel injectors 32 in a conventional manner such as, for example, via threaded fastening. Male spherical sealing surfaces 58 located toward the other end of fuel tubes 50, however, may slidingly engage female conical seating surfaces 56 of ports 54 as common manifold 34 is moved into position. To retain common manifold 34 in position relative to fuel tubes 50 and engine 10, retention devices 52 may be placed over common manifold 34 and secured with fasteners 76. After assembly of fuel system 12 to engine 10, a space may exist between common manifold 34 and engine 10, and between flat outer surfaces 64, 66 and retention devices 52 to accommodate misalignment.

Fluid system 12 may provide a simple arrangement for disconnecting any misalignment that may exist between retention devices 52 and ports 54 or fuel tubes 50 from stress levels induced within fluid system 12. In particular, because retention devices 52 only constrain common manifold 34 in a single direction (e.g., in the axial direction of fuel tubes 50), the affect of this misalignment may only be experienced in the single direction. This single direction of misalignment may be accommodated by varying the engagement depth of fuel tube 50 into port 54. The engagement depth may be variable because of the deformation and/or deflection of ports 54 and the quill end of fuel tubes 50 that occurs during the engagement. Because a space is maintained between common manifold 34 and engine 10, sufficient depth may always be available. Misalignment between fuel tubes 50 or ports 54 may be accommodated with the increased flexibility of fuel tubes 50 and/or the ability of male spherical sealing surfaces 58 to rotate within female conical seating surfaces 56 while maintaining fluid sealing. The minimal number of components within fluid system 12 may reduce the assembly time, assembly cost, and component cost of power system 5.

It will be apparent to those skilled in the art that various modifications and variations can be made to the fluid system of the present disclosure without departing from the scope of the disclosure. Other embodiments will be apparent to those skilled in the art from consideration of the specification and practice of the fluid system disclosed herein. It is intended that the specification and examples be considered as exemplary only, with a true scope of the disclosure being indicated by the following claims and their equivalents.

The invention claimed is:

1. A fluid system for an engine comprising:

a manifold having a plurality ports;

a retention device configured to constrain the manifold relative to the engine in only a single translational direction; and a plurality of tubes configured to communicate fluid from the ports with the engine and to constrain the manifold in the remaining translational directions, one of the plurality of ports and the plurality of tubes including at least one female conical seating surface.

2. The fluid system of claim 1, wherein the one of the plurality of ports and the plurality of tubes that includes at least one female conical seating surface includes a plurality of female conical seating surfaces and the other of the plurality of ports and the plurality of tubes includes male spherical sealing surfaces.

3. The fluid system of claim 2, wherein the plurality of ports includes the female conical seating surfaces.

4. The fluid system of claim 3, wherein the plurality of tubes are quill tubes.

5. The fluid system of claim 1, wherein the retention device includes a clamp having a recess configured to receive the manifold.

6. The fluid system of claim 5, wherein the manifold is movable relative to the clamp.

7. The fluid system of claim 1, further including at least one other retention device, each of the retention device and the at least one other retention device being associated with a different one of the plurality of ports.

8. The fluid system of claim 1, wherein the manifold has an asymmetric cross-section.

9. A fluid system for an engine comprising:

a manifold having a plurality ports and an asymmetric cross-section, the asymmetric cross-section including a first arcuate outer surface, a second arcuate outer surface opposite the first arcuate outer surface, a first flat outer surface disposed between the first and second arcuate outer surfaces, and a second flat outer surface opposite the first flat outer surface and disposed between the first and second arcuate outer surfaces;

a retention device configured to constrain the manifold relative to the engine in only a single translational direction; and a plurality of tubes configured to communicate fluid from the ports with the engine and to constrain the manifold in the remaining translational directions.

10. The fluid system of claim 9, wherein the first arcuate outer surface has a greater arc length than the second arcuate outer surface and the plurality of ports are disposed within the first arcuate outer surface.

11. The fluid system of claim 10, wherein the retention device includes a clamp having a recess configured to receive the manifold, the recess providing a clearance between the clamp and the first and second flat outer sides of the manifold after assembly.

12. The fluid system of claim 1, wherein a space exists between the manifold and the engine after assembly.

13. The fluid system of claim 1, wherein the single translational direction is an axial direction associated with the plurality of tubes.

14. A method of assembling a manifold to an engine, comprising:

engaging a retention device with the manifold to constrain the manifold relative to the engine in only a single translational direction; and engaging the manifold with a plurality of tubes extending from the engine to communicate fluid from the manifold with the engine and to constrain the manifold relative to the engine in the remaining translational directions, including engaging at least one male spherical sealing surface with at least one female conical seating surface.

15. The method of claim 14, wherein engaging the manifold with the plurality of tubes includes engaging a plurality of male spherical sealing surfaces with a plurality of female conical seating surfaces.

16. The method of claim 14, further including engaging at least one other retention device with the manifold to constrain the manifold relative to the engine in the single translational direction, wherein each of the retention device and the at least one other retention device is associated with a different one of the plurality of ports.

17. The method of claim 14, wherein engaging the manifold with the plurality of tubes prevents the manifold from contacting the engine after assembly.

18. A power system comprising:

an engine having a plurality of combustion chambers; and a fuel system configured to supply pressurized fuel to the combustion chambers, the fuel system having:

a manifold with a plurality ports, each of the plurality of ports including a female conical seating surface;

a retention device configured to constrain the manifold relative to the engine in only a single translational direction; and a plurality of quill tubes configured to communicate fluid from the ports with the engine and to constrain the manifold in the remaining translational directions.

19. The power system of claim 18, wherein each female conical seating surface is configured to receive a male spherical sealing surface of one of the plurality of the quill tubes.

20. The power system of claim 18, further including at least one other retention device, each of the retention device and the at least one other retention device:

being associated with a different one of the plurality of ports;

including a clamp having a recess configured to receive the manifold; and being movable relative to the manifold.

21. The power system of claim 18, wherein the manifold includes an asymmetric cross-section having:

a first arcuate outer surface;

a second arcuate outer surface opposite the first arcuate outer surface;

a first flat outer surface disposed between the first and second arcuate outer surfaces; and a second flat outer surface opposite the first flat outer surface and disposed between the first and second arcuate outer surfaces, wherein the first arcuate outer surface has a greater arc length than the second arcuate outer surface and the plurality of ports are disposed within the first arcuate outer surface.

22. The power system of claim 21, wherein the retention device includes a clamp having a recess configured to receive the manifold and the recess maintains a clearance between the clamp and the first and second flat outer sides of the manifold after assembly.

23. The power system of claim 18, wherein a space exists between the manifold and the engine after assembly.

* * * * *